United States Patent [19]
Stansberry
[11] 4,199,147
[45] Apr. 22, 1980

[54] HORSE RACE BETTING GAME

[76] Inventor: Charles D. Stansberry, Rte. 2, Box 199, Andersonville, Tenn. 37705

[21] Appl. No.: 943,861

[22] Filed: Sep. 19, 1978

[51] Int. Cl.[2] ..... A63F 3/00
[52] U.S. Cl. ..... 273/274; 273/246
[58] Field of Search ..... 273/274, 246

[56] References Cited

U.S. PATENT DOCUMENTS

| | | | |
|---|---|---|---|
| 2,070,605 | 2/1937 | Leighton | 273/246 |
| 2,823,919 | 2/1958 | Scruggs | 273/246 |
| 4,043,557 | 8/1977 | Johnston | 273/86 R |

*Primary Examiner*—Anton O. Oechsle
*Attorney, Agent, or Firm*—Biebel, French & Nauman

[57] ABSTRACT

A horse race betting game includes a playing board with three columns, a first column representing the finish positions of the horses entered into a race, a second column representing the number of the race and a third column representing the horses which are entered into the race. The playing board also has thereon the record times for each of several track lengths. Included with the game is a relatively large number of horse race cards. These cards contain precomputed horse race finish times for a given horse by track length and track condition and also include the odds of winning for the particular horse for each track condition. The game also includes a pay-off board on which is contained the winning amounts for each denominational bet and for each of the odds for winning. Each player receives a betting envelope and three designators or flags within which envelope he places his bet and a designator as to whether he is betting the horse to win, place or show. The object of the game is one of judgment in that a player may only look at one horse race card and from it determine whether or not to bet on the particular horse to win, to place or to show, and how much to bet, or whether the player desires to bet on one of the other cards which he has not seen. The winner is determined by which player has won the most money at the conclusion of the races.

4 Claims, 10 Drawing Figures

FIG-2

16 18a 18b 15 18c 18d

| | MUDDY | SLOW | GOOD | FAST |
|---|---|---|---|---|
| 5f | 106 1/5 | 106 | 106 | 105 4/5 |
| 5 1/2f | 100 1/5 | 100 2/5 | 100 2/5 | 100 1/5 |
| 6f | 114 2/5 | 114 1/5 | 114 4/5 | 114 2/5 |
| 1m | 145 3/5 | 145 4/5 | 145 2/5 | 145 1/5 |
| 1 70 | 142 1/5 | 142 | 142 2/5 | 142 2/5 |
| 1 1/16 | 144 4/5 | 144 4/5 | 144 1/5 | 144 |
| ODDS | 3:1 | 6:1 | 4:1 | 2:1 |

15a 19 19 19 19

16 18

| | MUDDY | SLOW | GOOD | FAST |
|---|---|---|---|---|
| 5f | 103 | 104 1/5 | 104 1/5 | 104 2/5 |
| 5 1/2f | 109 | 109 1/5 | 109 2/5 | 109 3/5 |
| 6f | 116 | 116 | 116 | 116 |
| 1m | 142 4/5 | 142 3/5 | 142 2/5 | 142 3/5 |
| 1 70 | 145 2/5 | 145 4/5 | 145 2/5 | 145 |
| 1 1/16 | 143 | 143 2/5 | 143 1/5 | 143 1/5 |
| ODDS | 3:1 | 2:1 | 4:1 | 5:1 |

15b

| | MUDDY | SLOW | GOOD | FAST |
|---|---|---|---|---|
| 5f | 103 4/5 | 103 3/5 | 103 3/5 | 103 2/5 |
| 5 1/2f | 101 4/5 | 101 3/5 | 101 2/5 | 101 1/5 |
| 6f | 112 4/5 | 112 3/5 | 112 2/5 | 112 |
| 1m | 141 | 141 3/5 | 141 | 141 3/5 |
| 1 70 | 146 4/5 | 146 3/5 | 146 2/5 | 146 |
| 1 1/16 | 147 3/5 | 147 | 147 | 147 4/5 |
| ODDS | 6:1 | 7:1 | 8:1 | 10:1 |

15c

FIG-4

22

SUBTRACT 1/5 — 22a

SUBTRACT 2/5 — 22b

SUBTRACT 4/5 — 22c

FIG-3

20

GOOD 5 FURLONGS — 20a

MUDDY 5 FURLONGS — 20b

SLOW 5 FURLONGS — 20c

FAST 1 MILE — 20d

MUDDY 5½ FURLONGS — 20e

SLOW 6 FURLONS — 20f

FIG-9A

| ODDS | $5 | | | $10 | | | $20 | | |
|---|---|---|---|---|---|---|---|---|---|
| | 1 ST | 2 ND | 3 RD | 1 ST | 2 ND | 3 RD | 1 ST | 2 ND | 3 RD |
| 1:1 | $10 | $8 | $7 | $20 | $15 | $13 | $40 | $30 | $26 |
| 2:1 | $15 | $10 | $8 | $30 | $20 | $17 | $60 | $40 | $34 |
| 3:1 | $20 | $13 | $9 | $40 | $25 | $20 | $80 | $50 | $40 |
| 4:1 | $25 | $15 | $10 | $50 | $30 | $24 | $100 | $60 | $48 |
| 5:1 | $30 | $18 | $11 | $60 | $35 | $27 | $120 | $70 | $54 |
| 6:1 | $35 | $20 | $12 | $70 | $40 | $30 | $140 | $80 | $60 |
| 7:1 | $40 | $23 | $13 | $80 | $45 | $34 | $160 | $90 | $68 |
| 8:1 | $45 | $25 | $15 | $90 | $50 | $37 | $180 | $100 | $74 |
| 9:1 | $50 | $28 | $17 | $100 | $55 | $40 | $200 | $110 | $80 |
| 10:1 | $55 | $30 | $18 | $110 | $60 | $44 | $220 | $120 | $88 |

FIG-9B

| $ 50 | | | $ 100 | | | $ 500 | | | $ 1000 | | |
|---|---|---|---|---|---|---|---|---|---|---|---|
| 1 ST | 2 ND | 3 RD | 1 ST | 2 ND | 3 RD | 1 ST | 2 ND | 3 RD | 1 ST | 2 ND | 3 RD |
| $100 | $75 | $68 | $200 | $150 | $136 | $1000 | $750 | $680 | $2000 | $1500 | $1360 |
| $150 | $100 | $85 | $300 | $200 | $170 | $1500 | $1000 | $850 | $3000 | $2000 | $1700 |
| $200 | $125 | $100 | $400 | $250 | $200 | $2000 | $1250 | $1000 | $4000 | $2500 | $2000 |
| $250 | $150 | $120 | $500 | $300 | $240 | $2500 | $1500 | $1200 | $5000 | $3000 | $2400 |
| $300 | $175 | $135 | $600 | $350 | $270 | $3000 | $1750 | $1350 | $6000 | $3500 | $2700 |
| $350 | $200 | $150 | $700 | $400 | $300 | $3500 | $2000 | $1500 | $7000 | $4000 | $3000 |
| $400 | $225 | $170 | $800 | $450 | $340 | $4000 | $2250 | $1700 | $8000 | $4500 | $3400 |
| $450 | $250 | $185 | $900 | $500 | $370 | $4500 | $2500 | $1850 | $9000 | $5000 | $3700 |
| $500 | $275 | $200 | $1000 | $550 | $400 | $5000 | $2750 | $2000 | $10000 | $5500 | $4000 |
| $550 | $300 | $220 | $1100 | $600 | $440 | $5500 | $3000 | $2200 | $11000 | $6000 | $4400 |

HORSE RACE BETTING GAME

BACKGROUND OF THE INVENTION

This invention consists of a horse race betting game which is played by the use of cards which contain precomputed race finish times and by comparing these against given race record times for each of a plurality of race track lengths and determining by judgment on which horse to bet and how much.

A number of horse racing games have been suggested in prior art patents. These include U.S. Pat. Nos. 3,690,666 issued Sept. 12, 1972; 3,883,143 issued May 13, 1975; 2,070,605 issued Feb. 16, 1937; 3,416,802 issued Dec. 17, 1968; 3,963,243 issued June 15, 1976; and 4,033,587 issued July 5, 1977. Each of the above-identified prior patents is characterized by the fact that the order in which the horses finish the race is determined more or less by chance, such as by the spinning of a wheel or the throwing of dice.

SUMMARY OF THE INVENTION

The present invention differs from the prior art of which I am aware, as identified above, in that the finish times for each of the horses involved has been precomputed and is not subject to chance. The game is accordingly more of a thinking game in which each of the players tries to out think or outwit the other players in the game. A playing board is provided which includes spaces for a number of horse cards to be played, such as six. The horse cards themselves are provided, on one side, with a plurality of precomputed finish times for each of a number of preselected track conditions and track lengths with the odds of winning also being provided on the card for each of the track conditions. For example, there may be fifty-two cards provided for fifty-two different hypothetical horses and each card contains precomputed finish times for a number of given track conditions, such as "muddy", "slow", "good", and "fast", over a number of preselected race track lengths, such as 5 furlongs, 5½ furlongs, 6 furlongs, 1 mile, 1 mile 70 yards, and 1-1/16 miles. The playing board has indicated thereon the track record times for each of the above-identified track lengths.

At the beginning of the game, each player will receive a predetermined amount of betting money. The horse cards will be dealt by placing them on the playing board face down, and each participating player will be permitted to look at one card only. The race to be run as to the length of track and track condition will be selected from a second set of cards or slips on which all of the available combinations of track lengths and conditions are preprinted. In this manner, a player may look at one card and then may compare the actual finish time as given on the card, taking into account the selected track condition and race length, with the record time, and thus determine whether he believes his card is a winner and make a judgment as to how much he is willing to bet on the card, if anything, and whether he is going to bet on his horse to come in either first, second or third. Each player is provided with a betting envelope in which he may place his bet, and he is further provided with betting flags with consist of slips of paper on which is written either first, second or third. The player will then place one of the betting flags in his envelope with his bet.

However, the player is not obliged to bet on his horse but may bet on one of the other cards representing horses, although he has not seen the finish time printed on the other cards.

The game is further provided with a pay-off board on which is indicated the pay-out for each bet by denomination of bet in accordance with each of the particular odds of winning. In addition, bonus time cards are provided to each winner which he can use to his advantage in placing bets on subsequent races. The object of the game is to accumulate the greatest amount of money after playing a predetermined number of games.

An advantage of the game is that it permits each player to use a certain amount of finesse and psychology in playing the game. This can be expressed in the form of bluffs or other forms of expression in order to influence the betting of the other players. Thus, an object of the game is for the player to cause the other players either to bet on a losing card to keep them from betting on his card. For example, if a player receives a card which has a very good time on it when compared to the record times shown on the playing board, he should attempt not to show this either in his actions, emotions, or the amount which he bets on his card. He can do this by not letting the other players see him put a large amount of money in his betting envelope. However, a player at times, may let the other players see him put in a large amount of money which could draw some of the other players to his card, and he could then either bet on his card for third place, hopefully drawing some of the other players into betting on the card for first place, and thus causing them to lose the race. In addition, if a player decides not to bet on his card, and there are six horses in the race, he would then have three chances out of five to hit a winner if he bet for third place, since his card could be taken out of consideration because of a poor time on his card.

After all the bets have been placed, the horse race cards are then turned over and then are arranged on the playing board, together with the associated bets, in accordance with the times shown on the card for the given race and track condition involved. If there are any winners, the amount of the winnings is determined by reference to the pay-out board and the pay-out is then made from a bank of money to the winning player or players in accordance with their bet and in accordance with the manner in which they bet the horse to win, either first, second or third place.

It is accordingly an object of the game to provide a situation where there can be keen competition between the individual game players. Not only must a sophisticated player be able to make wise bets and to play his cards intelligently, but he also has the opportunity of keeping the other players from being as wise or playing as carefully as they might otherwise be capable of doing.

A further object of the invention is to provide a horse race betting game in which there is a playing board providing spaces for a plurality of horse race cards and in which there are a plurality of horse race cards having precomputed race times thereon, odds of winning, track conditions and race lengths.

Another object of the invention is to provide a horse race betting game in which there are provided a plurality of bonus cards having fractions of seconds of time printed thereon which a player may receive in response to winning one race, which the player may then use to improve his chances of winning in a succeeding race.

These and other objects and advantages of the invention will be apparent from the following description, the accompanying drawings and the appended claims.

BRIEF DESCRIPTION OF THE DRAWINGS

FIG. 2 represents three typical playing cards or horse cards used in playing the invention;

FIG. 3 illustrates six typical track and race cards employed in the game of this invention;

FIG. 4 illustrates three typical bonus cards;

FIGS. 9A and 9B, when taken together, illustrate the pay-out or pay-off board employed in the game of this invention.

DESCRIPTION OF PREFERRED EMBODIMENT

Figure 1:
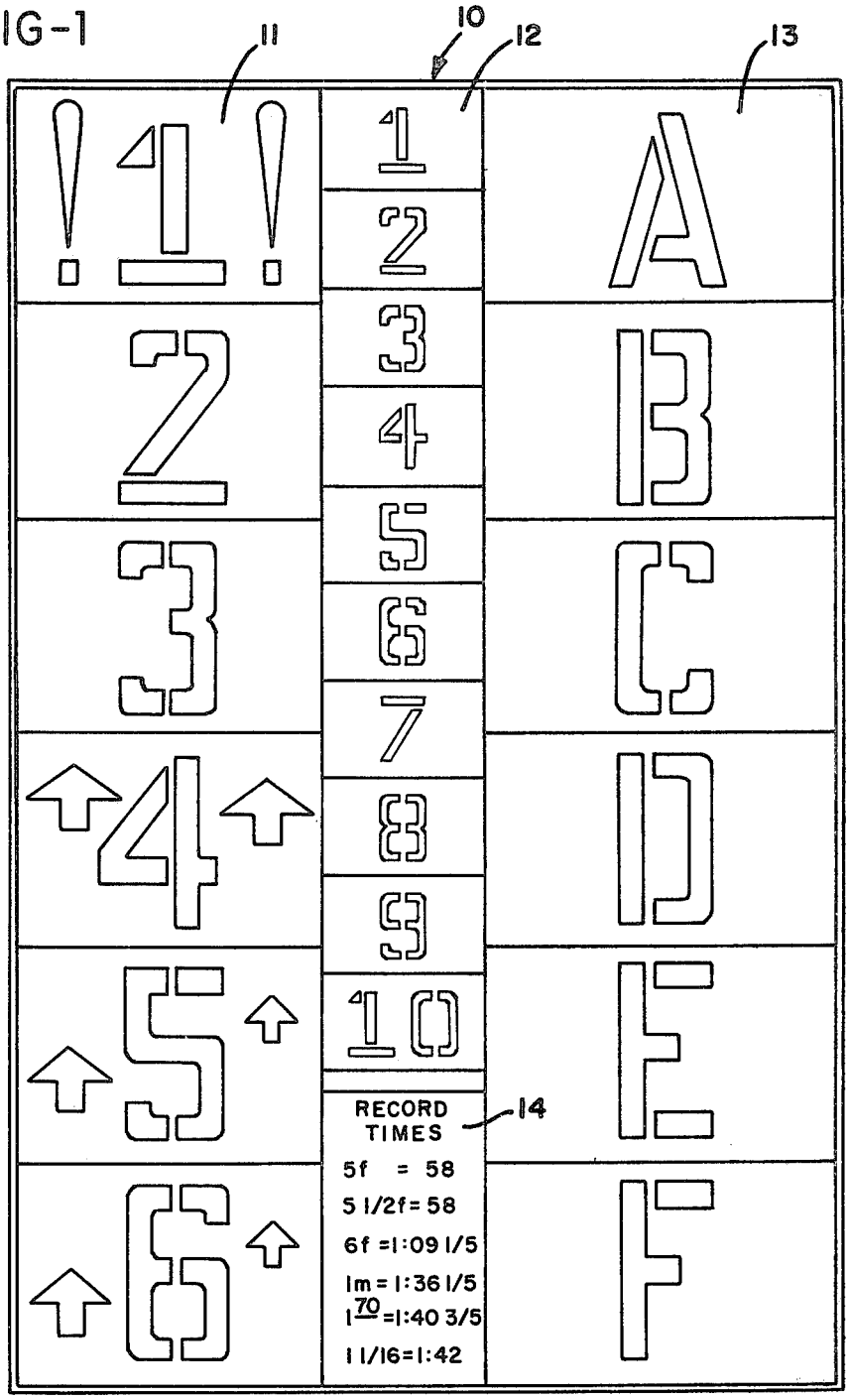
FIG. 1 is the playing board used with this invention.

The playing board is identified by the reference numeral 10 and is shown in FIG. 1 as having three columns arranged in rectangles or squares. The first column 11 extends the vertical height of the board 10 and has squares or places bearing the numeral indications, 1, 2, 3, 4, 5 and 6, representing respectively the race finish positions. A second and intermediate column 12 bears numeral indications 1 through 10 corresponding respectively to the number of the particular race being run, such as race No. 1, race No. 2, etc. The third column 13 is divided into spaces which are identical in size and spacing to those in column 11, except that the spaces bear the letter indications A, B, C, D, E and F in descending order. These letter designations also correspond to positions which are played by any one of the two to six persons which may be playing the game.

The column 12 not only includes the race numbers 1 through 10, but also and importantly, includes the record times, as represented by the reference numeral 14, for each of the several preselected race track lengths. The race track lengths which have been selected for the game are 5 furlongs, 5½ furlongs, 6 furlongs, 1 mile, 1 mile 70 yards, and 1-1/16 miles. The corresponding record times are displayed in association with each track length involved. For example, the record time for 5 furlongs is 58 seconds while the record time for 1 mile is 1 minute and 36-1/5 seconds. I prefer to present the record times as illustrated by the space 14 directly on the playing board 10, but it should be understood that the record times may be set forth on a separate card which will always be viewable and visible during the playing of the game, or if desired, the record times could be printed in association with the pay-off board illustrated in FIGS. 9A and 9B.

FIG. 2 represents three typical examples of the playing or horse cards 15 employed in this invention. The cards 15 are formed of a size as to fit neatly into either of the spaces represented by the columns 11 or 13 on the playing board 10. As noted above, three typical playing cards **15*a*, 15*b* and 15*c* are illustrated in FIG. 2. Each of the cards 15 is characterized by a left-hand column 16** on which is entered a plurality of preselected race track lengths.

The column 16 accordingly represents the race track lengths corresponding to those identified in the space 14 on the playing board 10. Four additional vertical columns **18*a* to 18*c* are provided on each of the playing cards 15 corresponding to four preselected track conditions; namely, "muddy", "slow", "good", and "fast". At the coordinates of the race track lengths at the race condition columns 18 are shown numbers which are precomputed race finish times for the particular horse involved, taking into account the track condition and track length. For example, referring to the first card 15*a* in FIG. 2**, this horse will complete a 5 furlong race, slow track, in 1 minute and 6 seconds. The same horse will compete a 1-1/16 mile race, fast track, in 1 minute, 44 seconds.

A plurality of different cards 15 are provided, the three being shown in FIG. 2 as representing typical examples. Preferably, fifty-two of the cards 15 are provided, corresponding to a conventional deck of fifty-two playing cards, with each of the individual cards 15 containing precomputed race finish times for a particular hypothetical horse. The invention, however, is not limited to the use of any particular number of playing cards, and the game may be played with as few as six cards, if desired, employing the board 10 of FIG. 1. However, I prefer to use a relatively large number of cards in order that the players will not have an opportunity to memorize what may be shown on any particular card before he has an opportunity to see it, and further to provide a wide variety of precomputed finish times in accordance with track condition and track length, to add variety to the game.

The cards 15 also contain one additional important feature, and that is a designation of the odds of winning at 19 for the horse represented by each particular card. Thus, looking at the first card **15*a* in FIG. 2, it will be seen that this horse has been given a 3 to 1 odds for a muddy track, a 6 to 1 odds for a slow track, a 4 to 1 odds for a good track, and a 2 to 1 odds for a fast track. This can be contrasted with the card 15*c* in FIG. 2 in which substantially higher odds of winning are presented. These odds of winning control the pay-off which will be made at the end of each game as identified by the pay-off board in FIGS. 9A and 9B. I prefer to show the odds of winning across the bottom of the card and directly in the columns 18 representing the preselected track conditions. Again, as in the case of the finish times, the odds of winning have been arbitrarily chosen with respect to each of the cards 15**.

FIG. 3 representes six specimens of the track and race cards 20. The cards 20 are proportioned in size to be positionable on the playing board over the individual squares or spaces represented by the race track positions in column 12, namely positions 1 through 10. The cards 20 provide means for selecting at random a given track length and a given track condition for a race. One of the race track cards 20 is provided for each combination of track length and track condition, with three typical examples being shown. Thus, the card 20 in FIG. 3 states that a 5 furlong race will be run under good track conditions. There are twenty-four of the cards 20 in all, and they are dealt out to be placed in sequence, one at a time, in the column 12 to designate the particular race which is going to be run.

FIG. 4 represents three typical examples of bonus cards 22. Each bonus card has printed on one side thereof the word "subtract" and a time indicated by fractions of a second. Bonus cards 22 are provided for 1/5 through 4/5, in 1/5 of a second increments. Preferably, fifty-two bonus cards are provided in each of the four denominations, and one card is given to a player each time he collects from winning a race in either the first, second, or third category, that is, by successfully betting the horse to win in first, second or third place. Thus, a player will, upon winning one race, receive at random one bonus card which he can use in any subsequent race to better his time, or the player may save the cards and use them all at once to subtract the amounts indicated on the cards from the times shown on the horse or playing card 15 which he has selected and bet on, to improve his chances for winning. Whether or not the cards help the player, once they are used by him they must be returned and go back into the stack of bonus cards.

Figure 5:
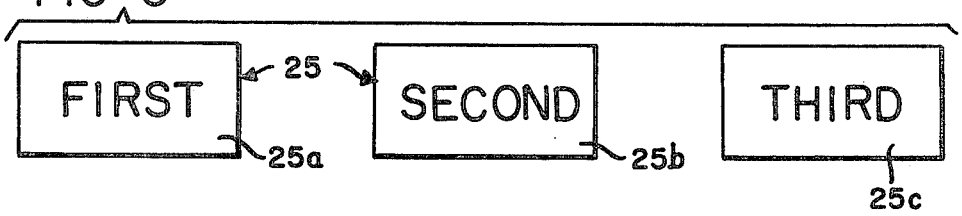
FIG. 5 represents the betting flags or betting tags used with this invention.

FIG. 5 illustrates the three betting tags 25 or flags which are provided to each player in the game. The betting flags are small slips of paper or cards which bear the designations "first", "second" and "third". Each player in the game receives one of the sets 25 of these cards for the purpose of designating his particular bet.

Figure 6:
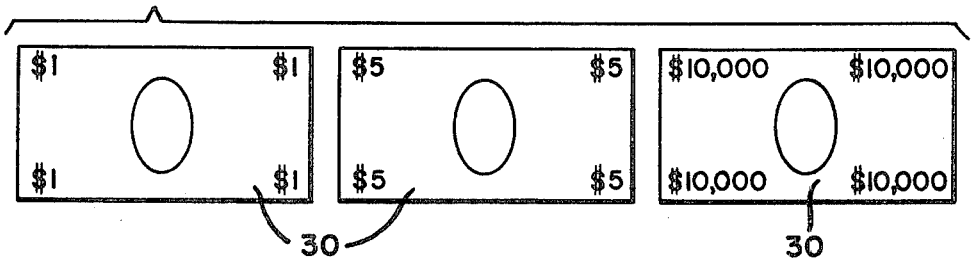
FIG. 6 illustrates three typical specimens of play money employed with the invention.

FIG. 6 illustrates three typical denominations of play money 30 employed in the game. Preferably, the play money is provided in denominations of $1, $5, $10, $20, $500, $1000 and $10,000 bills. The quantity of play money which is provided is not critical, but it should substantially exceed the amount which could reasonably be expected to be accumulated by any one player who has a winning streak and thus wins or successfully bets on a majority of each of the ten races to be played.

Figure 7:
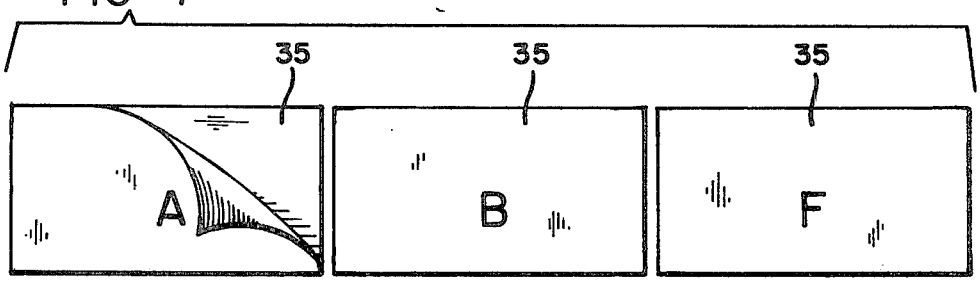
FIG. 7 illustrates three typical betting envelopes used by the players.

FIG. 7 represents three of the six betting envelopes 35 which are provided in the game. Each of the betting envelopes 35 is provided with one of the letters A through F for the purpose of associating the bet with the playing card positioned in the corresponding spaces A through F in column 13 of the playing board. Each player will receive a particular one of the envelopes 35 bearing the designations A through F and will retain the use of this particular envelope throughout the game. The envelope is proportioned to receive the play money 30 as well as the betting flags 25.

Figure 8:
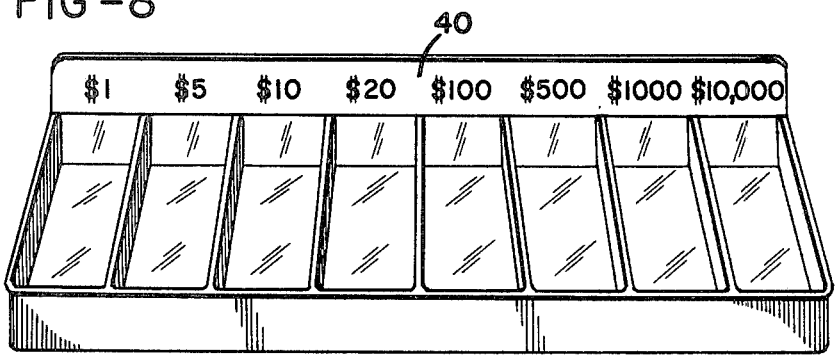
FIG. 8 illustrates a container for the play money.

FIG. 8 represents a suggested form of a bank or container 40 for receiving the denominations of the play money 30 as illustrated in FIG. 6. The bank represented by container 40 is normally controlled by a particular player which has been selected to deal the cards.

The pay-out or pay-off board 45 is illustrated in FIGS. 9A and 9B. The pay-off board is placed at all times in view of the players and contains thereon precomputed pay-outs for each bet in accordance with the denomination of the bet and the odds of winning. Thus, the board 45 has major column designations for bets ranging from $5 to $1,000, and under each major designation includes pay-offs for first, second or third place finishes corresponding to bets against the horse coming in first, second or third, and in a left-hand column, designates the particular odds of winning from 1 to 1 up to 10 to 1. Thus, in the spaces defined by the coordinates, the bank pay-outs are shown, rounded out to even dollars, for each denomination of the bet, that is, $5, $10, $20, $50, $100, $500, and $1,000 bets, and for each of the three finish positions.

The rules for playing the game are as follows: In the game as presented in the preferred embodiment, as few as two or as many as six players may play at any one time. First, a dealer among the players is arbitrarily selected to deal the cards 15 and make the pay-outs from the bank 40. First, each player receives $100 in money in the form of two $5, three $10, and three $20. Also, each player receives one set of the betting flags 25, and one of the betting envelopes 35. Both the playing board and the pay-off boards are set out where all players can see them. The selected dealer first turns up one of the race track and condition cards 20 from the deck of these cards and places it into position No. 1 in column 12. This then indicates the particular race which is to be run. He then shuffles the playing cards 15 and deals six of them face down in the respective spaces A through F in column 13.

Each player is then permitted to pick up the particular card 15 corresponding to the letter on the betting envelope 35 which the player has been given. The player then determines how much he is going to bet, in $5 increments, and places the betting money 30 in the envelope 55 together with one of the betting flags 25 to indicate whether he is betting on the horse to come in first, second or third place. If more than one betting flag is left in the envelope, the one that pays less is counted as the intended bet. For example, if a player puts in first and mistakenly leaves in third, then his bet is counted as third. If no betting flag is put in the envelope, then it is automatically a third place bet. Every player is required to make a bet, starting first with the player who dealt the cards. He makes his bet by comparing the time for the particular race given on his card with the record times 14 given on the board 10. As previously noted, he need not bet on his horse but may bet on one of the other horses, the cards for which he has not seen. In any event, the player usually does not permit the other player to see the amount of his bet or to see whether he is betting for first, second, or third, unless he particularly cares to do so. All of the players may bet on their own cards or they may place their bets all on the same card. The remaining players follow suit in the usual clockwise rotation until all of the bets are down. After the betting has started, no player is permitted to change his bet after he has placed the same on the particular card 15 in its location on column 13 of the board 10.

After all of the bets are placed, the dealer will then turn the cards over and place the cards, together with the accompanying bets, in the sequence of winning corresponding to the numbers in the column 11, in accordance with the times of finishing on the cards for the specific race, track length and track condition. Thus, the cards are all turned up in the winning or losing order and the dealer then checks each envelope, and if any of the bets are in the winning position numbers 1, 2 or 3 he determines who the winners are and makes the proper pay-outs from the bank 40 according to the bet, the particular odds of winning given on the card, and the amount which was bet, by referring to the pay-off board shown in FIG. 9. The money is taken out of all of the players' envelopes and returned to the bank or container 40 one by one and the winning players are then payed their winnings from the bank in accordance with the pay-out shown on the pay-out board as their envelope is checked.

Each time a player wins, he is also dealt one of the bonus cards 22, as illustrated in FIG. 4. These cards may then be saved by the winning players and used in subsequent races for the purpose of reducing, for that particular player, the time shown on the card 15 on which he has bet by the fractional second of time shown on the bonus cards. The bonus cards are employed by placing them in the betting envelope at the time the bet is placed. When all of the cards have been checked and the winners, if any paid, all of the players are given back their particular betting envelopes 35 and their betting flags 25 and the six playing cards 15 are collected and put on the back of the deck.

The next race is played the same as the first, except that the deal is rotated to the left in the conventional manner, a new race and track condition card 20 is selected from the deck of these cards, and placed in space number 2 of column 10, and six new horse playing cards are placed face down in Positions A through F in column 13. By rotating the deal to the left, as preferred, this rotates the person who is required to bet first in each race and thus rotates the advantage of betting last. The person who bets last has the advantage of seeing how all of the other players bet on their own cards or on one of the other cards that such other players did not see.

There are ten races in the game and after the ten races, the player who has accumulated the most money is the winner. If any player goes broke before the game ends, he may attempt to borrow money from another player. He cannot borrow from the bank. If one of the other players wishes to loan money to the bankrupt player, that player may then continue. However, if no other player wishes to loan him money, the bankrupt player must drop out of the game.

As previously noted, my game does not depend upon the spin of a wheel, the throw of dice or other elements of chance with respect to determining whether a particular horse is going to win and by how much. Rather, preselected and precomputed finish times are printed on the cards 15, thus providing each player the opportunity to match his wits against the other players in determining whether and how much to bet, considering the odds of winning and considering the track record times provided. Each player must also decide when to use a bonus card which he may have collected in a preceding game, and must determine how much to bet on his card, whether to bet for first, second or third place, and whether or not he wishes to bet instead on one of the other cards. A player may bet on only one card in any one race.

For example, as part of the pyschology of playing the game, if a player receives a card with a very good time on it, he should try not to show this in his actions or in the amount which he bets on the card, since if other players see him put a large amount of money in his envelope, they too may decide to bet on his card because of his actions. As another example, a player could let the other players see him place a large amount of money in his envelope, but then he may insert only the third place betting flag 25 with the intent of drawing one or more of the other players to his card and causing them to bet either first or second, and thus placing to bet for third place on one of the cards other than his own, he knows he has three chances out of five to hit a winner. Accordingly, the game provides an opportunity to have sharp competition between each of the players, and due to the employment of a relatively large number of cards 15, there is little likelihood of the game becoming monotonous or of any one of the players becoming so skilled that he will dominate the playing of the game.

It is to be understood that in the broader sense, this invention is not limited in its application and use to a betting game involving horses as such. It may be used as a betting game in which conditions other than track length and track condition are employed to determine the finish time for a given entry or card. Thus, it may be considered that the track lengths shown in column 16 comprise a first condition or parameter and the track conditions shown at the top in columns 18*a* through 18*d* represent a second condition or parameter, and the cards 20 are employed to designate the first and second conditions for a given race or betting sequence.

While the form of apparatus herein described constitutes a preferred embodiment of this invention, it is to be understood that the invention is not limited to this precise form of apparatus, and that changes may be made therein without departing from the scope of the invention.

What is claimed is:

1. A horse race betting game comprising a playing board having columns arranged in squares representing race finish positions, race numbers and horses entered into each race, and further having entered thereon the track record times for each of a plurality of given race track lengths, a plurality of horse playing cards having entered on one side thereof a plurality of precomputed race finish times for a corresponding plurality of individual races by given track conditions and according to said race track lengths, and further having hypothetical odds of winning thereon for the horses represented by said card for each of said track conditions, said cards being proportioned to be positionable on said playing board in the squares represented by said horse race column, a betting envelope for each player participating in the game, "first", "second" and "third" betting flags for each of said players, race indicator cards positionable on said race number column of each playing board, each having entered thereon a discrete race by track condition and length, a quantity of play money in betting denominations, and a pay-off board providing for the pay-out of each bet denomination in accordance with the particular odds of winning and for each of the first, second and third place finishes, whereby a player can look at one of the horse race cards, compare the race and track conditions as represented by one of said race indicator cards, and by considering the odds given on his horse race card and the track record times presented on the game board, determine whether and how much money to bet by placing money in his betting envelope, inserting the appropriate one said betting flag, and placing the bet on one of the horse cards in the horse column on the playing board.

2. A horse race betting game of skill and bluff comprising:

a plurality of individual cards corresponding to a plurality of horses, each of said cards having entered thereon race finish times corresponding to a number of track lengths and a number of track conditions, and further having thereon the odds of winning of said horse, a playing board having thereon spaces corresponding to a given number of horses to be entered into a race, said spaces being proportioned to accept a corresponding number of said cards for betting purposes, said board having thereon spaces representing the finishing positions of the horses entered into the race and further having thereon track record times for each of said track lengths, means for selecting at random a given track length and track condition for a given race, a plurality of betting envelopes for each game player, play money which may be entered into the betting envelopes, a betting indicator means for each of said players for designating whether the player is betting on a horse to come in first second or third, and a pay-off board providing pay-outs for each bet in accordance with the denomination of the bet and the odds of winning, whereby a player can look at the finish time for the horse represented by one of the cards in accordance with the selected track length and condition, can compare said finish time with the track record time, and can accordingly place his bet in his betting envelope on the horse represented by the card which he looked at or on one of the other cards in the game, and can indicate whether he is betting on the horse to come in first, second, or third.

3. The betting game of claim 2 including a plurality of bonus cards having thereon indications of small increments of time which are received by a player as a bonus in response to having successfully bet a winner in a preceding race whereby the player may utilize the bonus card in a subsequent race to deduct from the time for the subsequent race the amount of time shown on the bonus card.

4. A race betting game of skill and bluff comprising:

a plurality of individual cards, each of said cards having entered thereon a plurality of precomputed race finish times corresponding to a plurality of preselected conditions, and further having thereon the odds of winning as to each of said conditions, a playing board having thereon spaces corresponding to a given number of cards to be entered into a race and proportioned to accept a corresponding number of said cards for betting purposes, said board having thereon spaces representing the finishing positions of the cards entered into the race, card means having thereon record times for each of said race conditions, means for selecting at random a given race condition, a plurality of betting envelopes for each game player, play money which may be entered into the betting envelopes, betting indicator means for each of said players for designating whether the player is betting on a card to come in first, second, or third, and a pay-off board providing pay-outs for each bet in accordance with the denomination of the bet and the odds of winning, whereby a player can look at the finish time for a card in accordance with the selected condition, can compare said finish time with the record time, and can accordingly place his bet in his betting envelope on the card which he looked at or on one of the other cards in the game, and can indicate whether he is betting on the precomputed time on the card to come in first, second, or third.

* * * * *